United States Patent [19]

Klein

[11] Patent Number: 4,814,585

[45] Date of Patent: Mar. 21, 1989

[54] TEXTILE OR FABRIC AND METHOD OF PRODUCTION

[76] Inventor: Dan Klein, Westmarkstrasse 27, 7500 Karlsruhe 41, Fed. Rep. of Germany

[21] Appl. No.: 31,017

[22] PCT Filed: Jun. 11, 1986

[86] PCT No.: PCT/DE86/00244

§ 371 Date: Feb. 13, 1987

§ 102(e) Date: Feb. 13, 1987

[87] PCT Pub. No.: WO86/07518

PCT Pub. Date: Dec. 18, 1986

[30] Foreign Application Priority Data

Jun. 15, 1985 [DE] Fed. Rep. of Germany ..... 3521608

[51] Int. Cl.[4] ..... H05B 3/34

[52] U.S. Cl. ..... 219/545; 219/544; 219/549

[58] Field of Search ..... 219/545, 544, 546, 212, 219/213, 548, 549

[56] References Cited

U.S. PATENT DOCUMENTS

| | | | |
|---|---|---|---|
| 2,938,992 | 5/1960 | Crump | 219/546 X |
| 3,349,359 | 10/1967 | Morey | 219/545 |
| 3,721,799 | 3/1973 | Carlstrom | 219/545 X |
| 3,946,194 | 3/1976 | de la Bretonière | 219/213 |
| 4,063,069 | 12/1977 | Peeri | 219/545 |

*Primary Examiner*—E. A. Goldberg
*Assistant Examiner*—M. M. Lateef
*Attorney, Agent, or Firm*—John F. A. Earley; John F. A. Earley, III

[57] ABSTRACT

A thin-walled heating system is provided which has only a minimal thickness and must be easy to dismantle. For this a textile fabric is envisaged with a heating circuit arranged therein, whereby the heating circuit (2) runs entirely inside the fabric (20), with the exception of the electrical connection end-pieces (22, 24). The surface heating textile material for heating blankets, floors of rooms and the like has a sheet of fabric, an electrical heat-producing conductor wire embedded in the sheet of fabric and extending in a series of uninterrupted undulations from its first end portion located at a first end portion of the sheet of fabric to its second end portion located at a second end portion of the sheet of fabric, a first electrical contact lead at the first end portion of the conductor wire, a second electrical contact lead at the second end portion of the conductor wire, and fabric portions between each undulation of the conductor wire allowing for unimpeded cutting of the fabric (20) without severing the conductor wire and disrupting the flow of electric current through the conductor wire from the first end portion of the conductor wire to the second end portion of the conductor wire creating a first subsection (32) of the fabric connected to a second subsection (30) of the fabric by the conductor wire (2), and allowing for the second subsection (30) of fabric to be angled and properly aligned with respect to the first subsection (32) of the fabric to conform with the contours with the room, as required.

21 Claims, 4 Drawing Sheets

Figure 3:
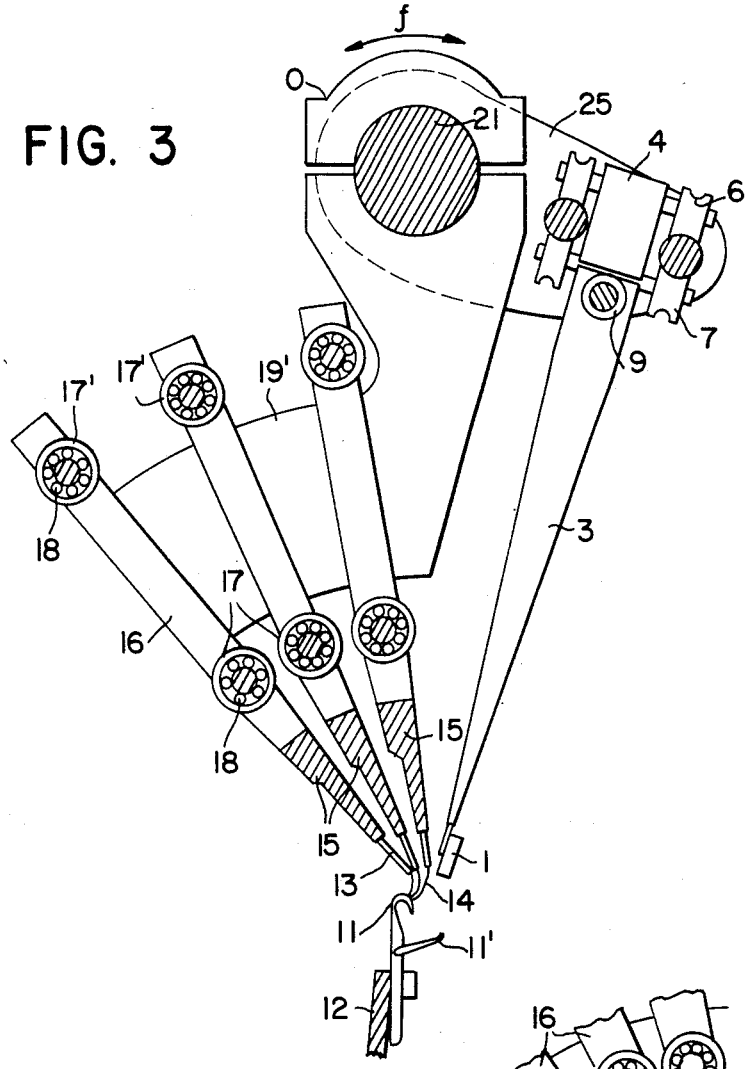

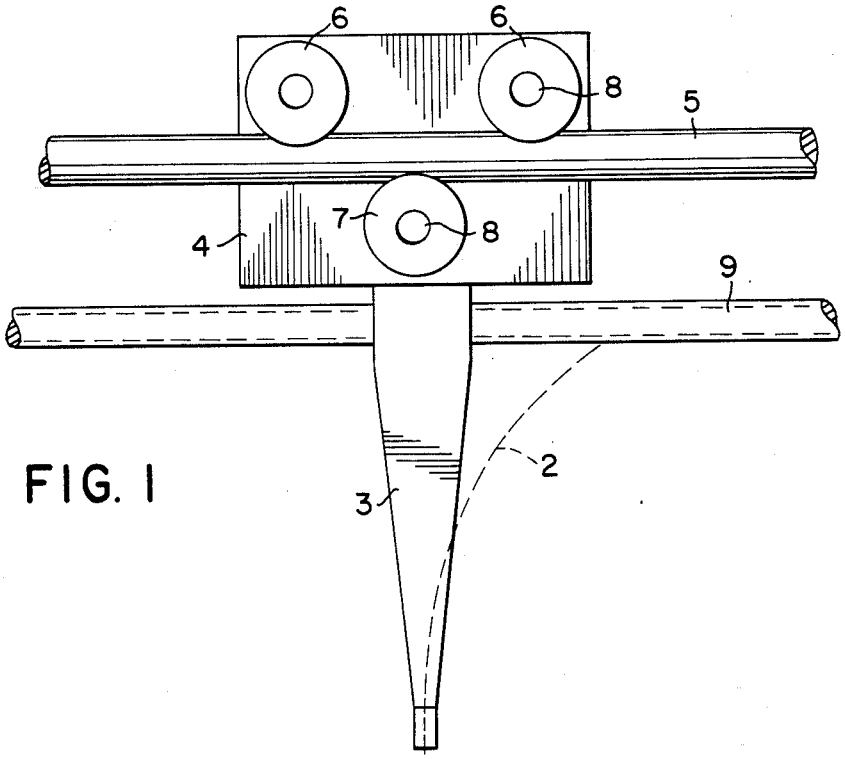
FIG. 1
FIG. 2
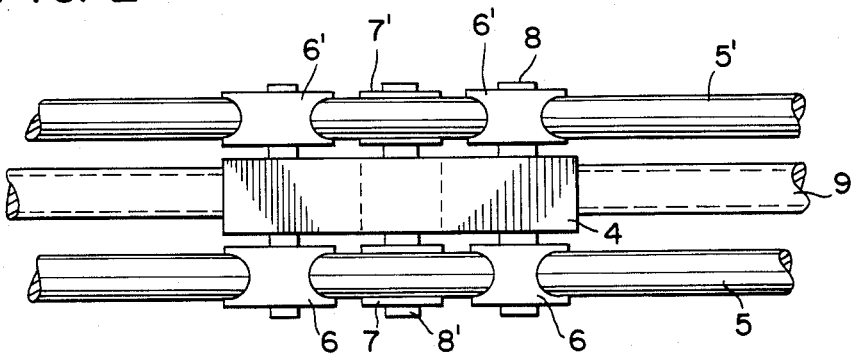

TEXTILE OR FABRIC AND METHOD OF PRODUCTION

The invention relates to a textile fabric containing a heat-producing electrical conductor and the method of producing such a fabric.

Various state of the art surface heating systems are known. Generally one distinguishes between two types of systems. In one type a heated fluid or gaseous medium flows through conduits and gives off heat to the surroundings, and in the other system an electrical current flows through a resistance heating conductor, thereby heating the conductor and giving off heat to the surroundings. The invention relates to systems of the latter art.

Conventional surface heating systems of this type consist of a suitable resistance heating wire disposed in a fixed matrix. Plates of various size can be produced whereby the electrical resistance heating conductors are connected by soldering during installation to form a closed heating system. Such systems are very bulky and the installation is time-consuming, furthermore the soldering points may be defective and lead to operational problems.

A further electrical heating system is known by which the heat-producing conductor consists of a metal foil welded between two laminants. This heating system is available in thin foils of 0.2 mm thickness and preferably used as ceiling heating. As such, the material is relatively easy to handle. However, a disadvantage is that the material is only partially pliable and surface irregularities are difficult to correct. Essentially this material can only be applied to flat, smooth surfaces. It is not applicable, for example, to pipeline heating since it can not be adhered to pipe curvatures or the like.

Furthermore, all known surface heating elements have the disadvantage that they can be produced only with relatively small widths, so that large floor or ceiling surfaces must be installed with several heating elements comprising many heating circuits. This is undesirable and often does not meet the required safety regulations.

In addition tests have also been made wherein a textile fabric is used as a matrix through which a heat-producing electrical conductor has been drawn. This method, however, is not feasible on the industrial scale.

The object of the present invention is to present a surface heating system which is easy to produce, flexible, and can be applied to almost any surface or body and as far as possible adapts its form to such bodies. Further, the heating system should be as thin as possible and should allow large heat circuits, especially heat circuits with a large width.

The invention rests on the knowledge that known heating elements produced in the form of sized plates do not allow an enlargement of the heating surface. The same is true for systems produced as rolls with limited width which can only be varied in their length so that the application for large surfaces will always require soldering points or separate heating circuits. The invention provides a system for arbitrary length and width with fewer heating circuits or, most often, a single heating circuit.

The invention provides a textile fabric containing a heat-producing electrical conductor whereby the conductor can be disposed in the fabric in two different arts. In the first embodiment, the conductor is completely embedded in the fabric with the exception of the electrical contact leads, i. e. between the outer extremity of the conductor at the edge of the fabric a zone free of conductors remains (with the exception of the region of the electrical connector leads).

With this embodiment comprising a zone free of conductors it is possible by installation to cut and form the fabric at a distance from the conductors, in particular shortly before the turnaround point of the conductor (continuing the cut would cut the heating conductor which should not occur), thereby leaving a small portion of connecting fabric about which the two portions of fabric can be revolved and laid next to another. Depending on the angle with which one segment of fabric is revolved with respect to the other, arbitrary configurations of the fabric or the heating conductors can be achieved without cutting the conductor circuit. Moreover it is possible to construct singular and closed heating circuits for large surfaces without impairing the maintenance work or the security of the system, since the individual sections are still connected with another by a common piece of fabric. For example, by revolving in a plane one segment of fabric by 180° with respect to the other, the two segments lie parallel to one another so that the width of the fabric is doubled without cutting the conductor circuit. Such fabric segments can be prefabricated and delivered and assembled at the building site or the like.

In addition to the above art, the invention also comprises a fabric in which the conductor circuit with the exception of the connector leads runs between and along at least to opposite edges of the fabric and at least one side of the fabric is laminated, whereby the laminant coating extends beyond the edge of the fabric. In contrast to the first embodiment, the conductor circuit runs over the entire width of the fabric and, in particular, up to the edge of the fabric. If this fabric was not provided with a covering and it was cut and revolved as described previously, a region free of heating conductors would result and two segments of the fabric would be formed which are only connected with one another through the heating circuit.

Although this variation is possible in principle, the safety of such a system is reduced.

Therefore the invention provides a textile fabric with conductors extending over the entire width of the fabric, wherein the fabric is covered at least on one side and wherein the covering extends behind the edge of the fabric so that segments of fabric can be cut and formed analogous to the first embodiment and the segments of fabric can be connected to one another in the overlapping edge areas. In the same way as described previously a large surface heating element results by which, for example, the segments can be bound together and by which the advantage of having a single heating circuit can be realised despite large or unusual spacial conditions.

Obviously the covering can also be provided in the first embodiment. The covering has the additional advantage that it serves as a protection for the heat-producing electrical conductors and, especially if it consists of a laminate covering, it serves as a dust protection.

A preferable embodiment of the invention provides a heating circuit with a sinuous pattern, although any other arrangement in the fabric is possible and will often depend on the particular application.

Due to the flexibility and pliability of the fabric according to this invention it can be used in many applications. It can be used for floor heating as well as ceiling or wall heating. It is, however, also possible to fabricate curtains. Furthermore, the textile fabric as a surface heating element according to this invention can be used for heating blankets or bed sheets as well as pillows and the like. Other applications are possible, for example a sheathing for pipelines and the like, whereby pipe couplers can easily be covered and the fabric bonded to them. The fabric is also applicable in medical and cosmetic areas, for example heat treatment of parts of the human body, where the fabric can not only be adapted to the form of the body, but also the conductor circuit can be so disposed as to heat only certain surfaces.

One embodiment provides a heating circuit in which the electrical contact leads are located on opposite ends of the fabric.

By revolving one segment of the fabric by 180°, a positioning is achieved in which the leads are in close proximity and parallel to one another and can be directly connected.

The heating element comprises an electrical conductive wire with a coating of heat resistant and electrically insulating material. According to the invention the conductor comprises a threaded cable, for example with 3 to 7 wires, which is wound with 1 to 4 Kelvar threads. The wire are a copper alloy, for example a copper-nickel alloy, however they can be a chrome-nickel alloy or of other electrically conductive materials. The threaded cable is coated with a polytetrafluoroethylene mantle, whereby in the fabrication a double insulation can be of advantage.

Depending on the application and the resistance of the conductor, it is displaced in the fabric so that the individual lines of the heating circuit maintain a certain distance, preferably 2 to 6 cm, but smaller or larger distances for certain applications are possible. The spacing will depend on the desired or allowed (required) heat requirement.

In a preferred embodiment, a laminate cover is provided, for example, with a non-woven fabric or felt. In principle, however, any covering is possible, for example, knitted material, cellulose material, synthetics or the like. Also, depending on the application, a foamed material can serve as the covering (laminate) and be fastened to the fabric, for example, with an adhesive.

It is advantageous when the covering is provided with an adhesive on its outer surface which extends beyond the fabric since then individual segments of the fabric can be bound with one another after cutting and revolving the segments, or the fabric can be easily attached to the ceiling, the floor or the like. This presents advantages in installation, which can be carried out by an unexperienced person since essentially no further material is necessary.

Depending on the design of the fabric, various perforations can be foreseen, which run from one end of the fabric and spaced between the heating circuit lines and up to the turnaround point in the sinuous path of the heating circuit. This make the separation of the fabric in various segments possible without the help of a cutting tool.

The invention also discloses a method of production for said fabric containing electrical heat-producing conductors. The method is characterized by the use of a Raschel machine with a row of vertical reciprocating bearded needles (11) and several rows of thread guides (13), which oscillate along the bearded needle row and guide the threads (14) to the bearded needles (11) whereby (a) the conductor wire is spanned between a first predetermined point to a second predetermined point within the width of the fabric to be knitted, (b) while the bearded needles are in their lowest position, (c) whereby spanning the conductor occurs at high speed, while the speed of the machine is greatly reduced or even set still, (d) subsequently the knitting operation is continued at normal speed as soon as the conductor is spanned, (e) followed by the production of a certain length of the fabric corresponding to the predetermined spacing between the consecutive conductor lines, (f) before the speed of the machine is reduced, and the conductor line is spanned in return from the second point to the first point, (g) whereafter the process is repeated from the beginning.

With this method, resistance heating wires (electrical heat producing conductors) can be displaced in arbitrary positions or configurations within the fabric. Furthermore the method guarantees that the conductors are fixed in the fabric and are essentially a part of the fabric.

The method consists of the following steps. The material is knitted in the usual way until the edge of a section with a certain length is reached. At this time the driving motor of the machine (preferably the mentioned Raschel machine) is completely stopped or reduced to a suitable slower speed. Then a certain length of the insulated conductor is drawn from a spool and laid along the heads of the bearded needles between two predetermined points within the width of the material. The withdrawal of the conductor is provided preferably with a guiding element, which is located near the thread guides and on the same level and which undergoes a reciprocating, lateral movement at the same speed over the needle heads. In contrast to the thread guides, which are so arranged that they transverse only short distances, the guide element for the conductor is provided with means which allow a relatively rapid movement between two predetermined points and the fixing of the conductor between these two points. After the guide element for the conductor has travelled from its start position at a certain point in the material to an end point, the motor of the Raschel machine returns to its full, normal speed.

The conductor is embedded in the overlapping threads and acts quasi as a weft or filler thread, similar to the filler threads of the material but shorter.

As the knitting of the material continues, the conductor is held down by the moving material. After a certain length of material has been knitted corresponding to the predetermined spacing between two neighbouring conductor lines, the guide element for the conductor moves in the reversed direction, whereby the conductor is drawn along the needle heads as described previously and the process of embedding the conductor in the fabric is subsequently continued in a back and forth manner.

In this way a textile fabric is produced, in which the conductor is completely under the surface of the fabric.

Only when separating the fabric into certain lengths are the electrical contact leads free. Naturally, this method is also suited for the production of a textile fabric in which the conductors run between and along at least two opposite sides of the fabric, whereby the conductor is lead from one edge to the other.

The arrangement which feeds the conductor filler thread comprises a tubular guide element, which is transported by a carrier mounted on a guide bar. The carrier is moved along the guide bar with known mechanical or pneumatic means. Control means stop the movement of the carrier or the guide element for the conductor on each end. The conductor spool and the corresponding guide element are preferably located on the side opposite to the side where the weft or filler thread is fed to avoid disturbances.

Instead of a single conductor (one single resistance heating wire) two or more conductors could be knitted into the fabric. Then, for example, two guide elements are mounted onto independent carriers, which draw the conductor from spools and these are worked into the fabric in the desired manner, whereby the arrangement and feeding of the conductors depends on the desired design.

The movement of the carrier along the guide bar is preferably attained with a long threaded spindle, which is arranged parallel to the guide bar and turned with an electric motor, whereby the carrier has a corresponding inside threading. such an arrangement makes it possible to start or interrupt the transport of the carrier and the guide elements for the conductors at any point along the material. The direction of movement can also be reversed by starting, stopping and reversing the direction of rotation of the electric motor through control and regulation means and again depending on the desired pattern of the conductors in the fabric.

The textile fabric according to the invention is thus not only easy and rapid to produce, also on the industrial scale, but it allows the covering of surfaces to be heated in practically arbitrary contours, lengths or points. Previous embodiments especially for large surfaces, have always required the connection of different heating circuits, for example, with non-heating connector wires, whereby safety is considerably reduced. The textile fabric provided here and the installation techniques according to the invention provide for the first time the production of a practically arbitrary surface heating element which can be configurated and laid in many different ways.

Figure 4:
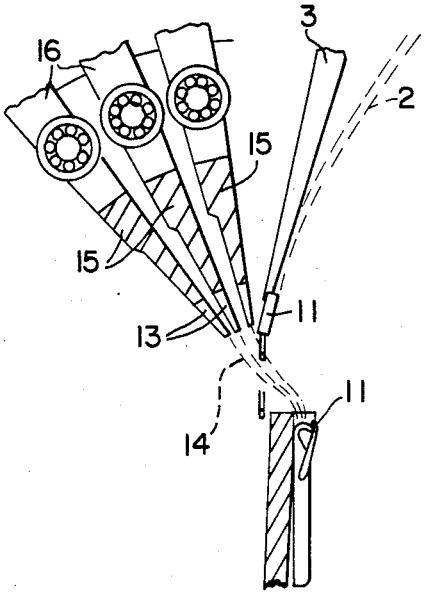
Figure 5:
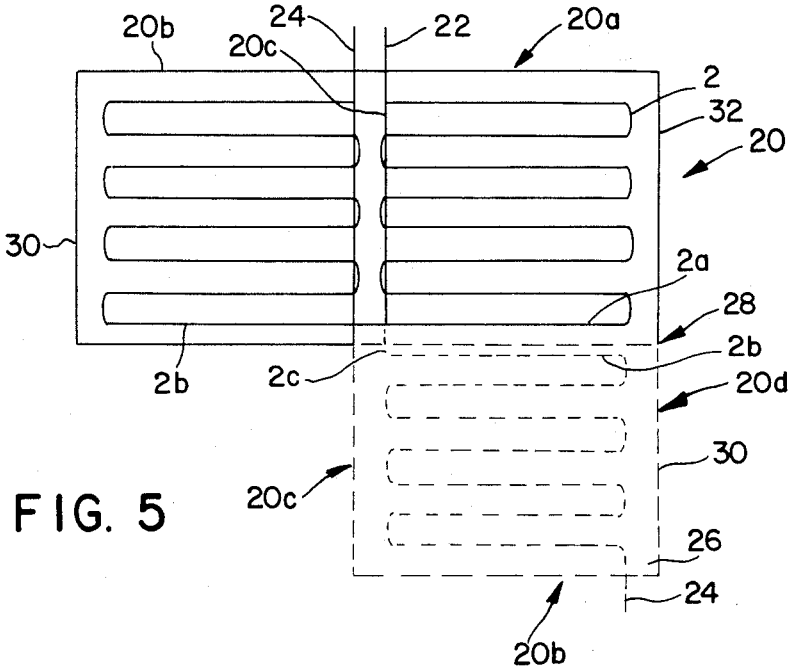
Figure 7:
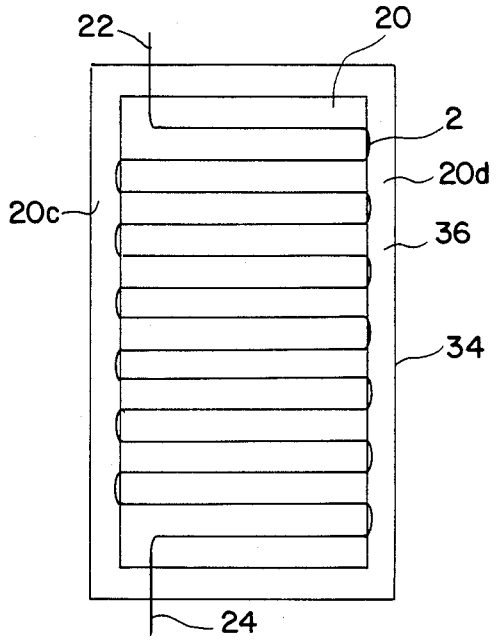
Figure 6:
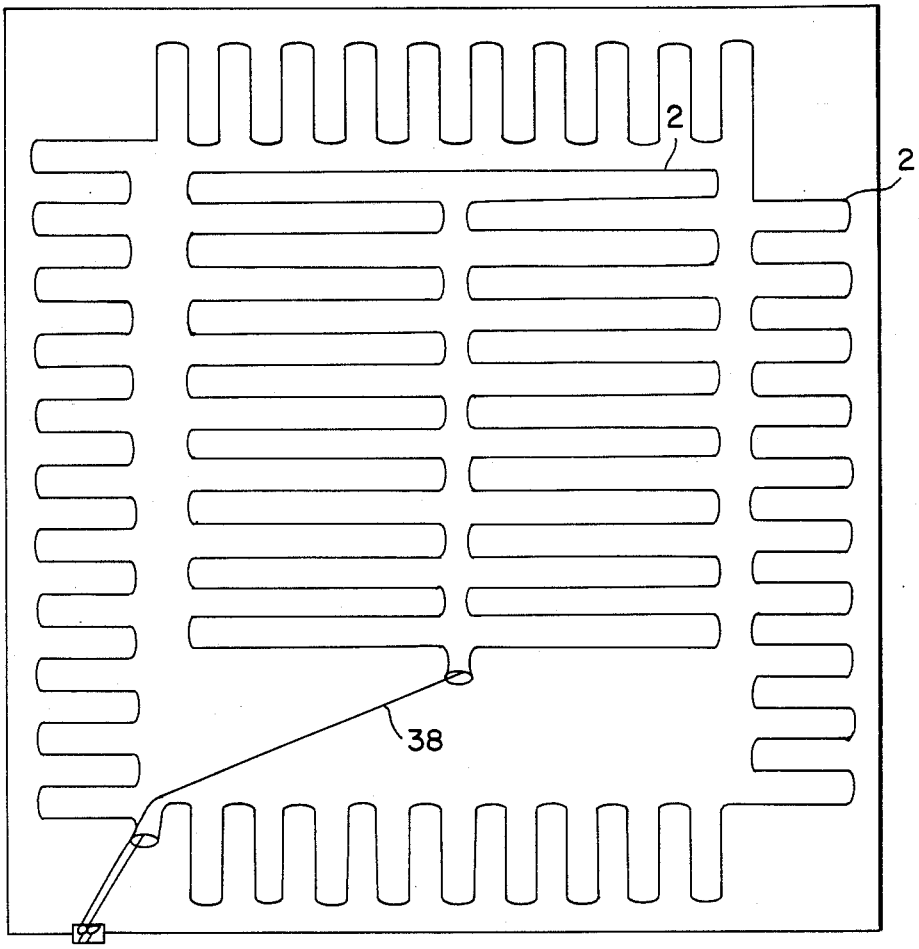

The object of the invention is described more fully with the accompanying drawings, in which:

FIG. 1 shows the front view of the carrier and transport means with the accompanying guide element as a component part of a Raschel machine, FIG. 2 shows a top view of the arrangement in FIG. 1, FIG. 3 is a schematic drawing of a section of the Raschel machine with three thread guides before the conductor is fed into the material, FIG. 4 shows the section as in FIG. 3 at the moment in which the conductor is fed between the threads, FIG. 5 shows the textile fabric according to the invention in different configurations, FIG. 6 shows a combined configuration of two textile fabrics according to the invention, FIG. 7 is a further embodiment of the textile fabric according to the invention.

Now referring to FIGS. 1 and 2, the invention comprises a guide element 1 for the conductor 2 in the form of a small short tube, by which the conductor 2 is lead to the material from a spool, drum, or the like. The guide element 1 is mounted on a vertical guide support 3, whose upper end is connected to the body 4 of the carrier. The carrier is mounted on two guide bars 5, 5′ having a circular cross section, which are fixed on each end on a common end support 25 (FIG. 3). The end supports 25 are fixed on both ends of the Raschel machine and form a component part of the machine. The carrier travels along the guide bars 5, 5′ on the three rollers 6, 6′, 7, 7′ on each side, whereby the rollers are provided with a curved indented surface on their contact side which joins with the upper and lower section of the guide bars 5, 5′. The rollers 6, 6′, 7, 7′ are fixed to the body 4 of the carrier on the axis 8, 8′ upon which they are mounted preferably with ball bearings.

The motion of the carrier along the guide bars 5, 5′ is accomplished with a threaded spindle 9 which acts with a corresponding inside threading in the guide support 3. The threaded spindle 9 is mounted on the end supports 25 and is driven in clockwise or counterclockwise direction by an electric motor which is also arranged on one of the end supports 25.

Now referring to FIGS. 3 and 4, the introduction of the insulated conductor into the knitted material is illustrated. The drawing shows a knitting machine of the Raschel type with the following components: a row of bearded needles undergo a reciprocating motion in the vertical direction and are positioned in slits in the guide plate 12. Each bearded needle 11 is accompanied by a tongue 11′ which holds the needle open in the upper position, as shown in FIG. 3, and closed in the lower position, as shown in FIG. 4. Above the needles, 3 to 6 rows of thread guides 13 are positioned (3 rows in the illustrated embodiment), which guide the threads 14 to the bearded needles through small holes on the tips of the guides 13 from spools located on top of the machine (not illustrated). The thread guides 13 in each row are fixed in parallel on three guide bars 15 such that they move in transverse direction with relatively small distances (up to 50 mm) in alternating directions, in particular, each row of thread guides undergoes a different movement and different distance. The guide bars 15 are mounted on the guide supports 16 which glide along the guide bars 17, 17′ on ball bearings 18, 18′ which sit in the guide supports 16. The guide bars 17, 17′ are fixed at their ends onto supports 19 which are clamped to a guide bar arm 21 by the cover 20. The arm 21 undergoes a reciprocal motion as indicated by the arrow f, in particular about a small angle, from a position in front of the bearded needles (FIG. 3) to a position behind them (FIG. 4). This movement occurs simultaneously with the up and down movement of the needles 11 in such a way that the thread guides 13 are in front of the needles when they are in their open position at the peak of their movement and are behind the needles when they are in their closed and lowest position.

The relative motion of the bearded needles 11 and the thread guides 13 allows the bearded needles 11 to grasp the threads and form loops whereby the fabric is knitted row for row. An insulated conductor 2 is fed by the previously described element 1 behind the needles 11 whereby it undergoes an oscillating motion together with the thread guides 13 since the guide bars 5, 5′, as described previously, are fixed to the end supports 25 which are clamped to the swing arm 21.

The guide element mounted on the carrier is so arranged that it can traverse the entire width of the needle row. With a signal, the rotary speed of the machine motor is reduced and the carrier is moved at high speed along the guide bars 5, 5′ by the rotating threaded spindle 9 between two predetermined points on the material being knitted, whereby the conductor is spanned along the threads 14. When the end point is reached, the rotary speed of the machine motor is increased to normal speed and the conductor is then knitted into the fabric through the motion of the threads and needles.

The guide element 1 for the conductor remains in its end position while the normal knitting process continues and the conductor is drawn downward with the completed fabric until a new signal is given to reduce the speed of the motor and to actuate the carrier in the reverse direction with the threaded spindle 9, whereby a second conductor weft is laid parallel to the previous one.

The regulation and control of the motor speed and the motion of the threaded spindle 9 is provided preferredly with suitable electronic means, whereby the motor speed and the start and end points of the motion of the carrier can be easily altered depending on which pattern is to be achieved, i. e. the manner in which the conductor is to be knitted into the fabric.

If two conductors are to be knitted into the fabric, two carriers and two guide elements on separate guided rods are provided and the method is otherwise the same as described previously. A fabric made in this manner is shown in FIG. 5. Now, referring to FIG. 5, the right end part of the figure shows the knitted fabric in its original form. The fabric, designated 20, has a rectangular form with two short sides 20*a,b* and two long sides 20*c,d*. The upper edge 20*a* exhibits a free connector lead 22 coming from the conductor circuit 2 which follows a sinous path through the fabric 20 which maintains a distance to the edges 20*a–d*. On the bottom edge 20*b* a second connector lead 24 extends freely beyond the edge zone 26.

The fabric can be produced in great length, maintaining one single conductor 2. However, the width of the fabric 20 is limited by the characteristics of the machine.

A doubling of the width of the section shown in the righthand side of FIG. 5 is easily achievable when, beginning at point 28 at the right edge 20*d*, a cut is made between the parallel conductors 2*a*, 2*b*, in particular, to a point on the left side of the fabric just before the turnaround region 2*c* of the conductor 2.

When the fabric 20 is so cut, the lower section 30 of the fabric 20 is revolved 180° in a plane about the turnaround region 2*c*, and is laid next to the upper section 32, as illustrated in FIG. 5 with the solid lines.

Due to the special arrangement of the contact leads 22, 24, these are now directly next to one another and are easy to connect to an electrical supply.

Also, as can be seen in FIG. 5, the two halves 30, 32 can be connected with one another in the edge region 26, for example glued together, so that a closed, surface heating element results even though the segment had previously been cut.

With this installation method according to the invention it is possible to cover large surfaces with the fabric with a single conductor circuit. For example one half of a room can be covered in the longitudinal direction and then the second half by cutting and revolving a second segment as described above. Naturally it is possible not only to arrange the conductor in an arbitrary configuration within the fabric 20, but also to lay two or more segments of the fabric 20 with arbitrary angles to one another, as shown in the example in FIG. 6. Here, a large surface is illustrated consisting of two heating circuits, an inner one which essentially corresponds to FIG. 5, and an outer one made with a total of three cuts, in which the individual segments are then displaced 90° from one another. The result is a large inner heating circuit surrounded by a narrow outer circuit whereby the two can be connected afterwards with the connecting wire 38.

The fabric according to the invention represents a surface heating element which has a variety of applications, for example for domestic uses such as sleeping blankets or sheets and pillows. Industrial uses are, for example, the external heating of pipelines and containers, heating hallways, or heating rain gutters and drainages. Cosmetic and therapeutic applications include face masks, heating pads and bandages. Other uses are in agriculture for the heating of greenhouses, the heating of automobile seats and the like.

Due to the flexibility and pliability and also the ability to configure the conductor within the fabric, practically all configurations of the fabric are possible.

In FIG. 7, a further embodiment of the invention is illustrated in which the conductor exhibits a sinuous pattern, however in contrast to FIG. 5 it also runs along the edge areas 20*c,d*. Here, however, the fabric 20 is covered with a laminant 34, for example a thin foil which is bonded to the fabric 20, whereby the foil is larger than the fabric 20 so that a zone 36 free of conductors results which can, for example, be coated with an adhesive. The installation is analogous to that described previously, whereby the segments of the fabric 20 are then bonded in the edge zones 36 with the laminant.

Suitable materials for the fabric include both natural and synthetic yarns and fibres, but also included are the so-called man-made threads, i. e. yarns made from various raw materials in different processes.

While the previous description, the drawings, and the features of the invention presented in the claims are illustrative, various arbitrary combinations for the realization of the invention in different embodiments can be made without departing from the spirit and scope of the invention.

What is claimed is:

1. A surface heating textile material for heating floors of rooms and the like comprising:

a sheet of fabric having a first end portion, a second end portion, a first side portion, and a second side portion, an electrical heat-producing conductor wire embedded in the sheet of fabric, the conductor wire extending in a series of uninterrupted undulations from its first end portion located at the first end portion of the sheet of fabric to its second end portion located at the second end portion of the sheet of fabric, a first electrical contact lead at the first end portion of the conductor wire, a second electrical contact lead at the second end portion of the conductor wire, and fabric portions between each undulation of the conductor wire allowing for unimpeded cutting of the fabric without severing the conductor wire and disrupting the flow of electric current through the conductor wire from the first end portion of the conductor wire to the second end portion of the conductor wire creating a first subsection (32) of the fabric connected to a second subsection (30) of the fabric by the conductor wire (2), and allowing for the second subsection (30) of fabric to be angled and properly aligned with respect to the first subsection (32) of the fabric to conform with the contours with the room, as required.

2. The textile material according to claim 1, wherein the fabric is provided with a covering (34) on at least one side which extends beyond the fabric (20) on at least two opposing edges (20*a–d*).

3. The invention of claim 1, wherein the conductor (2) runs between and along at least two opposing edges (20*a–d*) of the fabric (20) with the exception of the electrical contact leads (22, 24) and is provided with a covering (34) on at least one side, which extends beyond the edges (20*a–d*) of the fabric (20), at least on these two sides.

4. The invention of claim 1, wherein the conductor circuit (2) in the fabric (20) has a sinuous pattern.

5. The invention of claim 1, wherein the electrical contact leads (22, 24) of the conductor circuit (2) are arranged on opposing edges of the fabric (20).

6. The textile material according to claims 1 to 5, wherein the conductor (2) comprises an electrically conductive wire and a coating of heat-resistant and electrically insulating material.

7. The textile material according to claim 6, wherein the conductor is a stranded cable of copper alloy.

8. The invention of claim 6, wherein the insulating coating consists of fiberglass, asbestos, silicon rubber, or polytetrafluoroethylene alone or in combination.

9. invention of claim 1, the fabric portions between each undulation of the conductor being 2 to 6 centimeters in length.

10. The invention of claim 1, wherein the conductor (2) between the electrical contact leads (22, 24) is one singular circuit.

11. The invention of claim 2, wherein the covering (34) is a laminate.

12. The invention according to claim 11, wherein the laminate comprises a non-woven fabric, felt, or the like.

13. The invention of claim 11, wherein the laminate is a foamed material.

14. The invention of claim 1, wherein the fabric is provided with a covering (34) on both sides.

15. The invention of claim 2, wherein the cover is at least partially provided with an adhesive in the region (36) which extends beyond the fabric (20).

16. The invention of claim 1, wherein the fabric is provided with a perforation which runs from one edge (20*a–d*) between the end portions of the conductor (2) and stops shortly before a portion connecting the first sub-section of the fabric to the second sub-section of the fabric.

17. A method of producing a textile fabric comprising a conductor on a Raschel machine with a row of vertical reciprocating bearded needles (11) and several rows of thread guides (13), which oscillate along the bearded needle row and guide threads (14) to the bearded needles (11), whereby:

(a) the conductor to be introduced is spanned along the threads form a first predetermined point to a second predetermined point within the width of the material to be knitted, (b) while the bearded needles (11) are in their lowest position, (c) whereby the conductor is spanned at high speed while the speed of the machine is greatly reduced or completely stopped, (d) subsequently the knitting operation is continued at normal speed as soon as the conductor is spanned, (e) thereafter a certain length of the fabric is produced corresponding to the predetermined spacing between two subsequent conductor sections, (f) before the rotary speed of the machine motor is reduced and the conductor is spanned form the second point back to the first point, (g) whereafter the process is repeated from the beginning.

18. A method of installing the surface heating textile material for heating floors of rooms and like according to any of claims 1 to 16 comprising:

cutting transversely across the fabric at the desired fabric portion without severing the conductor wire creating a first subsection (32) of the fabric above the cut connected to a second subsection (30) of the fabric below the cut by the conductor wire, and arranging the second subsection (30) of the fabric below the cut at the desired angle to conform with the contours of the room.

19. The method according to claim 18, including revolving the second subsection (30) below the cut by 180 degrees and laying it next to the fabric subsection (32) above the cut.

20. The method according to claim 19, including revolving the subsection (32) below the cut until the first electrical contact lead of the conductor wire is arranged directly next to the second electrical contact lead of the conductor wire.

21. A surface heating textile material for heating floors of rooms and the like comprising:

a sheet of fabric having a first end portion, a second end portion, a first side portion, and a second side portion, an electrical heat-producing conductor wire embedded in the sheet of fabric, the conductor wire extending in a series of uninterrupted undulations from its first end portion located at the first end portion of the sheet of fabric to its second end portion located at the second end portion of the sheet of fabric, a first electrical contact lead at the first end portion of the conductor wire, a second electrical contact lead at the second end portion of the conductor wire, fabric portions between each undulation of the conductor wire allowing for unimpeded cutting of the fabric without severing the conductor wire and disrupting the flow of electric current through the conductor wire from the first end portion of the conductor wire to the second end portion of the conductor wire creating a first subsection (32) of the fabric above the cut connected to a second subsection (30) of the fabric below the cut by the conductor wire, and allowing for the second subsection (30) of fabric to be angled and properly aligned with respect to the first subsection (32) of the fabric above the cut to conform with the contours with the room, as required, the fabric being provided with a covering (34) on at least one side which extends beyond the fabric (20) on at least two opposing edges (20*a–d*), the conductor (2) running between and along at least two opposing edges (20*a–d*) of the fabric (20) with the exception of the electrical contact leads (22, 24) and being provided with a covering (34) on at least one side, which extends beyond the edges (20*a–d*) of the fabric (20), at least on these two sides, the conductor circuit (2) in the fabric (20) having a sinuous pattern, the electrical contact leads (22, 24) of the conductor circuit (2) being arranged on opposing edges of the fabric (20), the conductor (2) comprising an electrically conductive wire and a coating of heat-resistant and electrically insulating material, the conductor being a stranded cable of copper alloy, the insulating coating consisting of fiberglass, asbestos, silicon rubber, or polytetrafluoroethylene alone or in combination, the fabric portions between each undulation of the conductor being 2 to 6 centimeters in length, the conductor (2) between the electrical contact leads (22, 24) being one singular circuit, the covering (34) being a laminate, the laminate comprising a non-woven fabric, felt, or the like, the laminate being a foamed material, the fabric being provided with a covering (34) on both sides, the covering (34) being at least partially provided with an adhesive in the region (36) which extends beyond the fabric (20), and the fabric being provided with a perforation which runs from one edge (20*a–d*) between the sections (2*a, b*) of the conductor (2) and stops short before the turnaround region (2*c*) of the conductor (2).

* * * * *